US011357319B1

(12) United States Patent
Tham

(10) Patent No.: US 11,357,319 B1
(45) Date of Patent: Jun. 14, 2022

(54) TABLE AND TABLE ASSEMBLY

(71) Applicant: Noble House Home Furnishings, LLC, Chatsworth, CA (US)

(72) Inventor: Siew Kin Tham, Chatsworth, CA (US)

(73) Assignee: NOBLE HOUSE HOME FURNISHINGS, LLC, Chatsworth, CA (US)

( * ) Notice: Subject to any disclaimer, the term of this patent is extended or adjusted under 35 U.S.C. 154(b) by 0 days.

(21) Appl. No.: 16/794,716

(22) Filed: Feb. 19, 2020

Related U.S. Application Data

(60) Provisional application No. 62/807,700, filed on Feb. 19, 2019.

(51) Int. Cl.

| | |
|---|---|
| ***A47B 7/00*** | (2006.01) |
| ***A47B 13/00*** | (2006.01) |
| ***A47B 13/08*** | (2006.01) |
| ***A47B 3/00*** | (2006.01) |

(52) U.S. Cl.
CPC ..... *A47B 7/00* (2013.01); *A47B 3/00* (2013.01); *A47B 13/00* (2013.01); *A47B 13/08* (2013.01); *A47B 2200/0001* (2013.01)

(58) Field of Classification Search
CPC .. A47B 7/00; A47B 3/00; A47B 13/00; A47B 13/08; A47B 2200/0001; A47B 13/088; A47B 2220/008; B25H 1/02
USPC ..... 108/163, 155, 156, 157.1, 158, 153.1
See application file for complete search history.

(56) References Cited

U.S. PATENT DOCUMENTS 925,314 A * 6/1909 Durand
1,062,996 A * 5/1913 Sornberger ..... A47B 3/087 108/36
1,104,018 A * 7/1914 Thiss ..... A47B 13/06 108/155
1,335,704 A * 3/1920 Russell ..... A47B 3/12 108/156
1,948,724 A * 2/1934 Laun ..... A47B 91/00 108/158
2,009,450 A * 7/1935 Hulson ..... F23H 17/12 126/168
2,579,934 A * 12/1951 Krasney ..... A47B 3/14 108/131

(Continued)

FOREIGN PATENT DOCUMENTS

CN 110448055 * 11/2019
DE 29509767 * 3/1996

OTHER PUBLICATIONS

KR2017001078 Abstract and figure; Park (Year: 2017).*
KR 2017014233; abstract and figure Jung Y G (Year: 2017).*
KR2019140678; abstract and figure; Lee B (Year: 2019).*

*Primary Examiner* — Janet M Wilkens
(74) *Attorney, Agent, or Firm* — Colin P. Abrahams

(57) ABSTRACT

A table assembly comprising a table surface having a first end and a second end. The assembly has a first end piece connectable to the first end of the table surface and a second end piece connectable to the second end of the table surface. There is further a first leg assembly connectable to the first end piece and a second leg assembly connectable to the second end piece. Each of the first and second leg assemblies comprises a pair of lateral legs having an upper surface connectable to its respective end piece, and a crossbar connectable to an extending between each of the pair of lateral legs.

10 Claims, 12 Drawing Sheets

(56) References Cited

U.S. PATENT DOCUMENTS

| | | | | | |
|---|---|---|---|---|---|
| 2,650,148 | A * | 8/1953 | Streng | F16B 12/48 | 108/155 |
| 2,731,316 | A * | 1/1956 | Cohen | B25H 1/02 | 108/158 |
| 3,049,386 | A * | 8/1962 | Homme | A47B 7/00 | 108/153.1 |
| 3,533,363 | A * | 10/1970 | Morris | A47B 3/12 | 108/153.1 |
| D227,515 | S * | 6/1973 | Mergens et al. | D28/93 | |
| 5,688,287 | A * | 11/1997 | Cline | A47B 91/022 | 108/154 |
| 6,142,560 | A * | 11/2000 | Miller | A47B 3/14 | 297/158.4 |
| 6,283,045 | B1 * | 9/2001 | Izumi | F16B 7/048 | 108/115 |
| 8,065,967 | B2 * | 11/2011 | Wong | B25H 1/02 | 108/181 |
| D734,630 | S * | 7/2015 | Bolton | D6/691.1 | |
| 9,526,328 | B2 * | 12/2016 | Illulian | A47B 3/083 | |
| D784,744 | S * | 4/2017 | Burden | D6/691.1 | |
| 9,622,568 | B1 * | 4/2017 | Lin | A47B 13/081 | |
| 9,862,088 | B2 * | 1/2018 | Luis y Prado | B25H 1/08 | |

* cited by examiner

| WOODEN PARTS | | | |
|---|---|---|---|
| No. | Components | Volume | |
| | | Thickness | Width |
| 1 | Long side frame (finger joint accepted) | 22 | 99 |
| 2 | Short side frame (finger joint accepted) | 22 | 99 |
| 3 | Slats (top) (laminated) | 10 | 99 |
| 4 | Long side rail 1 | 22 | 40 |
| 5 | Short side rail 1 | 22 | 40 |
| 6 | Long side rail 2 | 22 | 40 |
| 7 | Connector of table and 2 edges | 25 | 80 |
| 8 | Table top main connector | 22 | 40 |
| 9 | Slats support bars 1 | 12 | 52 |
| 10 | Slats support bars 2 | 12 | 40 |
| 11 | Slats support bars 3 | 12 | 52 |
| 12 | Slats support bars 4 | 12 | 40 |
| 13 | Corner blocks | 20 | 35 |

| IRON PARTS | | | |
|---|---|---|---|
| No. | Components | | |
| | | | |
| a | Legs 60x60x1.4 | | |
| b | Legs support bar - bottom 40x40x1.1 | | |
| c | Legs support bar - side 50x25x1.1 | | |

Fig. 10A

| Length | QTY |
|---|---|
| 1807 | 2 |
| 915 | 2 |
| 1807 | 7 |
| 1807 | 2 |
| 915 | 2 |
| 99 | 4 |
| 870 | 2 |
| 870 | 4 |
| 239 | 4 |
| 239 | 8 |
| 303 | 2 |
| 303 | 4 |
| 40 | 4 |

| Length | QTY |
|---|---|
| 715 | 4 |
| 1788 | 1 |
| 850 | 2 |

Fig. 10B

TABLE AND TABLE ASSEMBLY

CROSS-REFERENCE TO RELATED APPLICATIONS

This application claims the benefit of U.S. provisional patent application No. 62/807,700 filed Feb. 19, 2019, the contents of which are incorporated herein by reference in their entirety.

FIELD AND BACKGROUND OF THE INVENTION

This invention relates to a table and table assembly.

SUMMARY OF THE INVENTION

According to one aspect of the invention, there is provided a table assembly comprising: a table surface having a first end and a second end; a first end piece connectable to the first end of the table surface and a second end piece connectable to the second end of the table surface; and a first leg assembly connectable to the first end piece and a second leg assembly connectable to the second end piece, each of the first and second leg assemblies comprising a pair of lateral legs having an upper surface connectable to its respective end piece, and a crossbar connectable to an extending between each of the pair of lateral legs.

Preferably, the table surface comprises a plurality of parallel slats. At least some of the plurality of parallel slats are fixed to each other to form a slat unit. In one embodiment, the table surface comprises two slat units, each slat unit having an upper surface and a lower surface, the slat units being releasably connected to each other so that the upper surface of one slats unit is coplanar with the upper surface of the other slat unit, the upper surfaces of the two slat units providing the table surface which is substantially flat.

Further, adjacent parallel slats may be located at a distance relative to each other so as to provide a space between the adjacent parallel slats. The table surface may comprise two slat units which are in hingedly connected to each other and pivotally movable between a first compact position wherein one slat unit overlies the other slat unit and a second unfolded position wherein upper surfaces of each of the slat units are coplanar with each other to provide a substantially flat table surface.

Preferably, the table surface, first end piece, second end piece, first leg assembly and second leg assembly are releasably connectable to each other so that the table assembly can be selectively constructed and deconstructed.

In one embodiment, the table assembly further comprises a connector plate on the upper surface of each of the lateral legs. The first end piece and the second end piece may each have an upper surface and a lower surface, the upper surface being continuous with the table surface when the table assembly is assembled. A connector plate may be provided on the upper surface of each of the lateral legs, and a connector plate receiving area on the lower surface of the first end piece and the second end piece to which the connector plate is releasably attached.

The table assembly may further comprise brackets for connecting together a plurality of slats. Additionally, there may be a first set of side rails located on first opposing sides of the table surface, and a second set of side rails located on second opposing sides of the table surface. In one embodiment, a support bar extends between the crossbar of the first leg assembly and the crossbar of the second leg assembly, the support bar having opposing ends connectable to the first leg assembly and second leg assembly respectively. Corner pieces may be attachable to a lower surface of the first end piece and the second end piece.

In one embodiment, each connector plate comprises a central portion connected to the upper surface of the leg, a pair of lateral connector portions including predrilled holes on each side of the central portion, and fastening means for securing the legs to the first end piece or the second end piece utilizing the predrilled holes in the lateral connector portions.

The table assembly may be in the form of a knockdown kit, the kit comprising the table surface, the first end piece, the second end piece, the first leg assembly, the second leg assembly, connecting bolts and screws, and a tool for tightening or loosening the bolts or screws for constructing or deconstructing the table assembly.

According to a further aspect of the invention, there is provided a table assembly comprising: a table surface having a first end and a second end; a first end piece connectable to the first end of the table surface and a second end piece connectable to the second end of the table surface; and a first leg assembly connectable to the first end piece and a second leg assembly connectable to the second end piece.

According to yet a further aspect of the invention, there is provided a method of assembling the table comprising: providing a table surface having a first end and a second end; attaching a first end piece to the first end of the table surface and a second end piece to the second end of the table surface; and attaching a first leg assembly to the first end piece and a second leg assembly to the second end piece, each of the first and second leg assemblies comprising a pair of lateral legs having an upper surface which connects to its respective end piece, and a crossbar which connects to an extending between each of the pair of lateral legs.

In one aspect, therefore, the invention relates to a table and table assembly, which can be assembled and disassembled so that it can be suitably adapted for either usability, or storage and transportation. Preferably, the invention is for a wooden table comprised of a plurality of slats, connectors, support members and stabilizers which can be constructed into a table, and deconstructed when needed into a compact form, according to the situation. While a wooden table may be preferred, other materials may be used, including as examples metal, plastics, laminates and composites, or combinations thereof, and the invention is not limited to one type of specific material.

In accordance with one aspect of the invention, there is provided a table having a table top and tabletop supports. Preferably, the tabletop is comprised of a series of parallel slats or planks. The slats or planks may be discrete or separate slats, or a plurality of such planks or slats may be prefabricated into an assembled form. In one preferred embodiment, three such slats are raised substantially parallel to each other and manufactured so as to be connected to each other, for a more convenient assembly. Other arrangements and slats or planks numbers are also possible. These may be referred to herein as sets of slats.

In one form of the invention, the slats, or sets of slats, may be of two types. A first type comprises slats only, intended for the middle parts of the tabletop. A second type comprises slats which include a depending band or board, formed on the slats and which will be right at near the edge of the tabletop, providing it with a solid looking appearance, and enhancing its strength.

Additionally, the invention may comprise a one or more end pieces, each end piece having an upper surface which would preferably be co-planar with the top surface of the slats or sets of slats at each end thereof when the table is assembled. Each end piece may further comprise a depending band or board, similar in size and construction to those on the slats or sets of slats, and which would register with the depending band on the slats of the table so as to provide the assembled table with an appearance of continuity.

The end pieces are preferably attached to an edge of the table surface, and also connect to and support leg assemblies for supporting the table surface. These leg assemblies will comprise the tabletop supports. Each of the tabletop supports may comprise a pair of legs, each having an upper end which is connectable to the end piece, and a lower end which rests on a floor or substrate on which the table is mounted. The upper end may comprise flanges or plates, including predrilled holes, by means of which the leg assemblies may be firmly but releasably connected to an end piece.

Between each of the legs, there may be provided a transverse support. Preferably, this transfer support is on the inside surface of the legs. Further, between each transfer support on each side of the table, a longitudinal bar or support is inserted, and is provided to impart additional stability and strength to the table.

The various components are designed and configured so as to be disassembled and stored in a compact and secure manner. Further, assembly of the components is simplified by the presence of predrilled holes, which may be threaded, for receiving screws or bolts so that components are correctly and accurately located relative to each other to provide a steady and easy to construct table. Further, the invention may comprise the provision of the necessary tools and hardware for assembling and deconstructing the table, so that the tabletop is provided to the end-user or consumer in a form which allows assembly without any additional tools which may be required.

BRIEF DESCRIPTION OF THE DRAWINGS

In the drawings:

FIGS. 10A and 10B are an information table illustrating and providing details of the parts used, including sizes of components, for a preferred table in accordance with one embodiment of the invention;

DETAILED DESCRIPTION OF THE INVENTION

Figure 1:
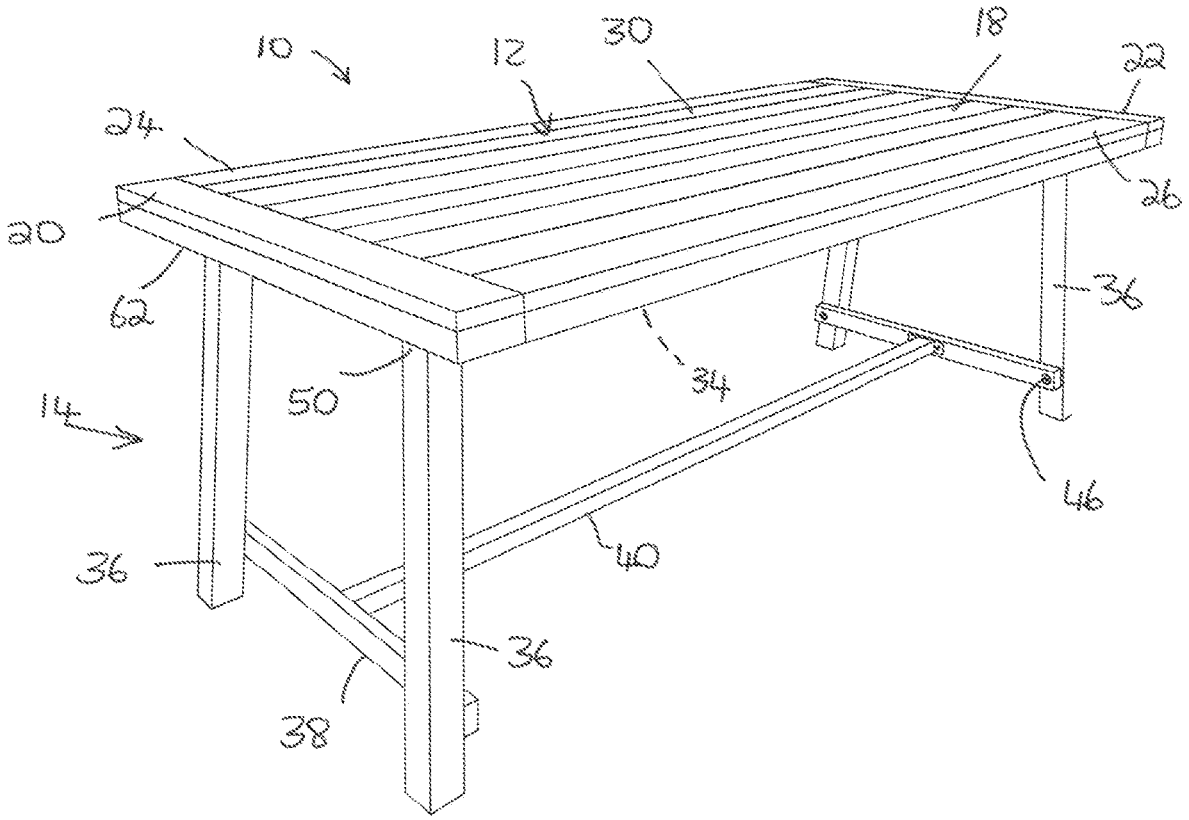
FIG. 1 is a perspective view of an assembled table from the left.

Reference is now made to the accompanying drawings, which show one embodiment of a table constructed in accordance with the present invention. However, many different embodiments of the table may be constructed, and fall within the scope of the present invention.

One preferred form of the invention comprises a substantially rectangular elongated table 10 having an upper or table surface 12, and supports or a leg system 14 for holding the upper or table surface 12. The upper or table surface 12 generally comprises a plurality of slats 18 arranged parallel to each other. End pieces 20 and 22 are located at each end 24 and 26 respectively of the plurality of slats 18. The table surface 12 has an upper surface 30 and a lower surface 34.

Each end piece 20 and 22 is designed to receive a leg system or assembly 14. Each leg system 14 comprises a pair of spaced legs 36 and a latitudinal or transverse crossbar 38 therebetween. To provide further support and stability, a longitudinal crossbar 40 is located between the pair of latitudinal or transverse crossbars 38. The various parts and components are held together with bolts or screws 46 or other types of connectors, and these bolts 46 may be received within pre-drilled and prepared holes or apertures, appropriately threaded, to facilitate construction and deconstruction of the table, as will be described in further detail below.

FIG. 1 of the drawings shows a top perspective view of a table 10 which has been constructed according to the present invention. It will be seen that the table 10 comprises a table top 12, a pair of supporting leg structures 14 at each end, and a crossbar 38 connecting the supporting leg structures 14. The tabletop 12 is comprised of a plurality of slats 18 or planks which are configured in parallel fashion, and there may be small spaces between each plank 18, or each plank 18 may abut adjacent planks so that a substantially full tabletop is presented without any spaces between the planks. It will also be seen in this figure that there are two end pieces 20 and 22, positioned and fastened at the short ends 24 and 26 of the tabletop 12.

The end pieces 20 and 22 are constructed so as to connect to and receive the supporting leg structures 14. At each end, the end piece 20 or 22 receives the top surface 50 of a pair of legs 36 which extend downwardly, and the two legs 36 are joined near their base by means of a transverse support post 38, so as to provide additional stability to the table. A longitudinal crossbar 40 may extend between the two transverse support posts 38 at each end, and, also, impart additional stability to the table. Such a longitudinal crossbar 40 may be utilized optionally, if needed. Whether such a crossbar 40 is used may depend, to some extent, on the sides of the table 10, where it may become necessary if the table 10 is longer. However, even a shorter table 10 may benefit from the presence of such a crossbar 40.

The slats or planks 18 may be prefabricated or constructed at the factory so as to be joined to other slats or planks 18. Thus, the slats or planks 18 make be provided to a user prefabricated, with three slats or planks 18 already joined to each other to form a slats unit 54. Such a slat unit 54 made up of a set of slats or planks 18 can be joined to similar such slat units 54, so as to reduce the number of connections which the end user or assembly person needs to perform, and assuring a more factory secure and strong set of planks. The number of slats 18 within a slat unit 54 will, of course, be determined by the width of the table, and also the convenience and economics of packaging so as to allow a disassembled table 10 to be transported in a cost effective manner.

Figure 2:
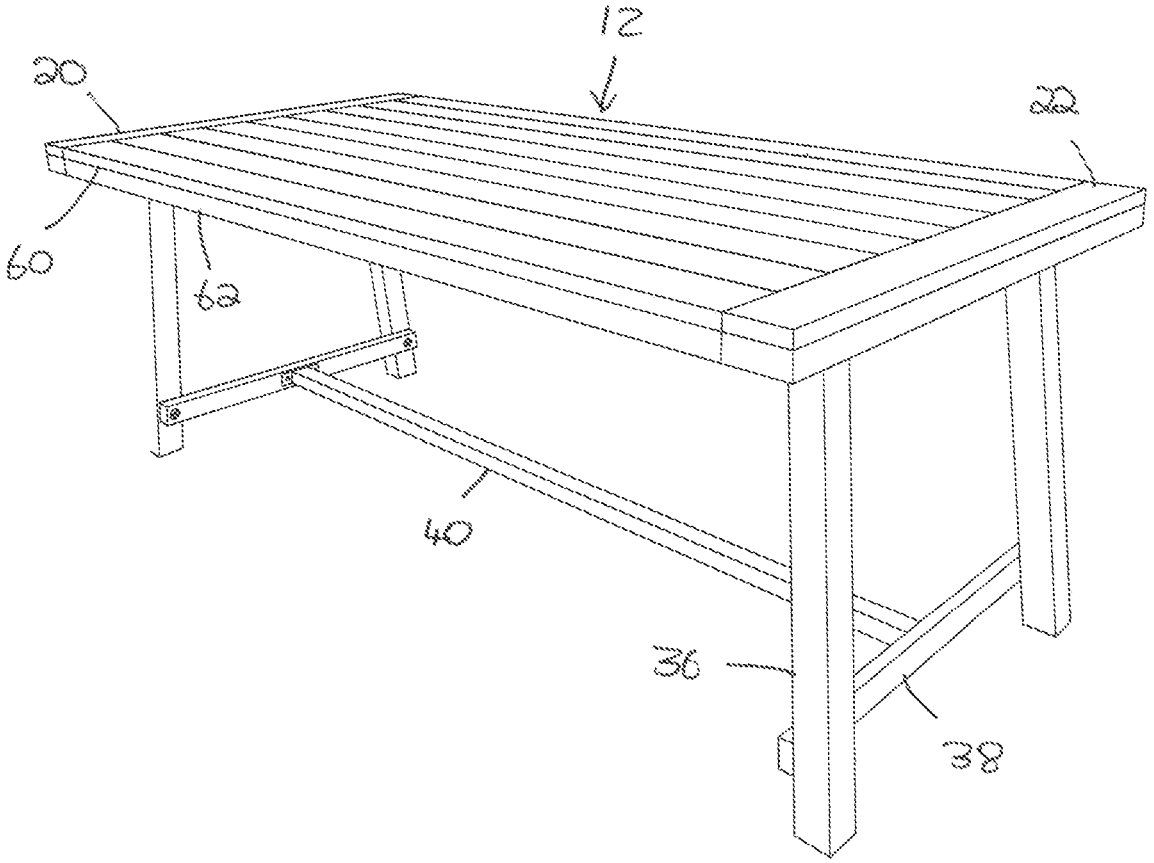
FIG. 2 is a perspective view of an assembled table from the right.

FIG. 2 of the drawings shows a table 10 as seen in FIG. 1, but comprises a perspective view from a top right position. It can also be seen in this figure that each end plank 18, on the long side of the table, may have a small flange or overlap 60, and include an elongate band 62 thereunder. This provides additional support to the table 10, and may also enhance its appearance aesthetically by providing a more complete, continuous and functional finish to visual aspect. The end pieces 20 and 22 may also be similarly constructed, with the overlap 60 and band 62 thereunder, the band 62 of the end piece 20 or 22 corresponding with the band 62 on the planks 18 so as to provide a continuous structure and look. The flange or overlap 60, as well as the band 62, may be preassembled and fixed at the factory, or it may be removable so that the end-user can install these components. Different sized flanged is or overlaps or bands, which may have different sizes, surface ornamentation or color, may be provided within a single kit so that the end-user has options in creating a more distinctive or unique table in the assembled form.

Figure 3:
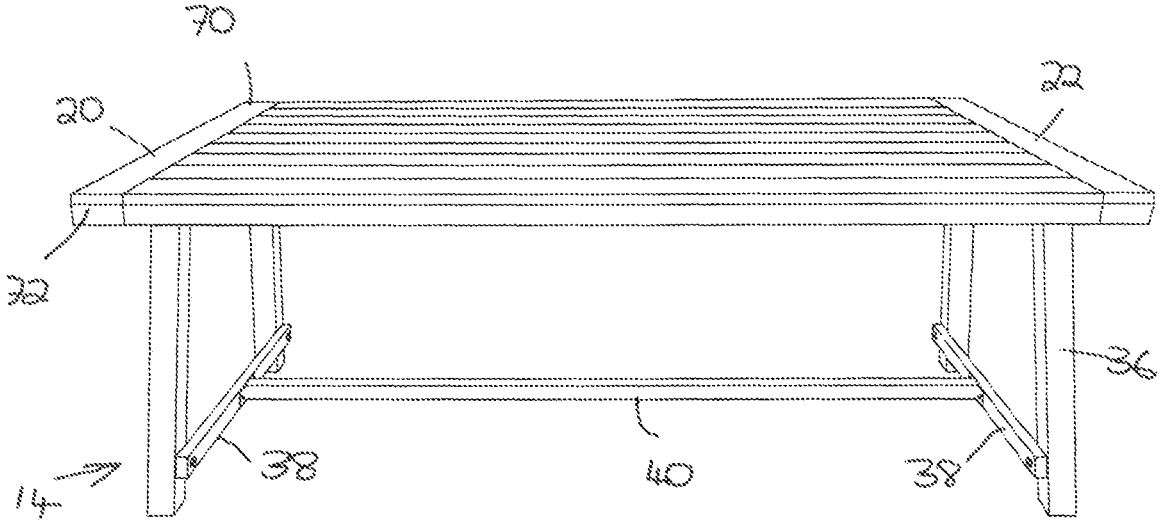
FIG. 3 is a perspective view of an assembled table from the center.

FIG. 3 of the drawings shows a front perspective view of the table 10 in accordance with the invention. These slatted tabletops 12 are comprised of a series of parallel slats or planks 18 as can be seen, and each long end has a slats or planks which have a small flange 60 and a depending band 62. The short edge 24 or 26 of the tabletop 10 has attached thereto an end piece 20 or 22. The end piece 20 or 22 has an upper surface 70 and a lower surface 72, the upper surface being substantially co-planar with the tabletop 12 portion defined by the planks or slats 18, and also has the depending band 62 which corresponds with the bands 62 of the depending band on the main table portion 12. These end pieces 20 and 22 not only provide structural integrity, but also are able to hide or cover or mask any narrow gap between slats. The end pieces 20 and 22 may also be used to cover the edges of the tabletop 12 which may have a rougher finish, since such edges will not be visible with the assembled table.

This FIG. 3 also shows the leg structure 14, with the transverse bar 38 on the inside surface of each of the legs 36. The outer facing edge of the transverse bar 38 may be slightly chamfered or rounded, so as to present no sharp points, surfaces or edges, and the smoothing out may thereby help minimize or reduce any scratches or cuts or discomfort which may otherwise be incurred by the user.

Figure 4:
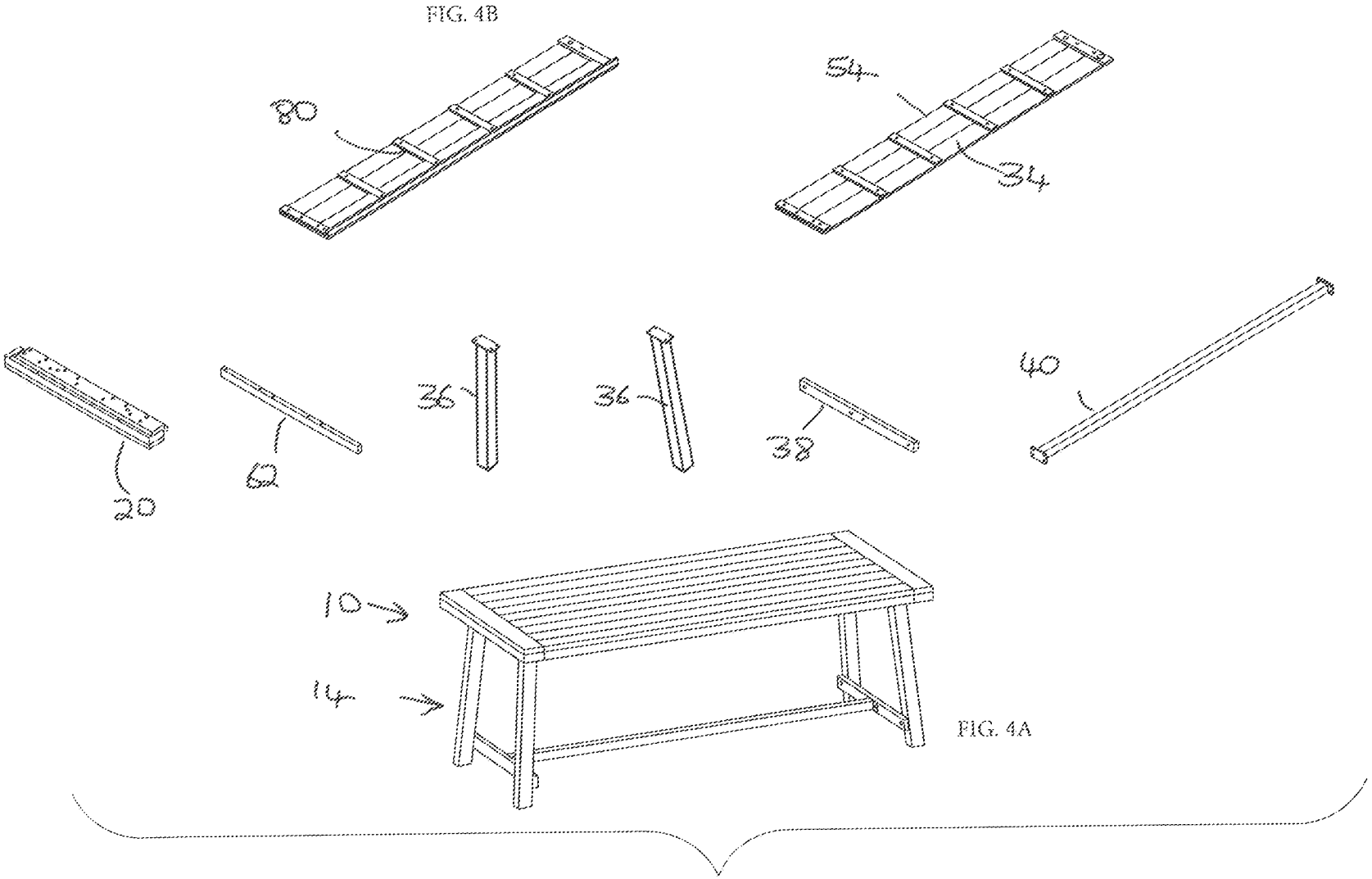
FIG. 4A illustrates a further perspective view of the table of the invention.
FIG. 4B shows a deconstructed view of the table components and the hardware and tools required for assembly, including quantities.
Figure 5A:
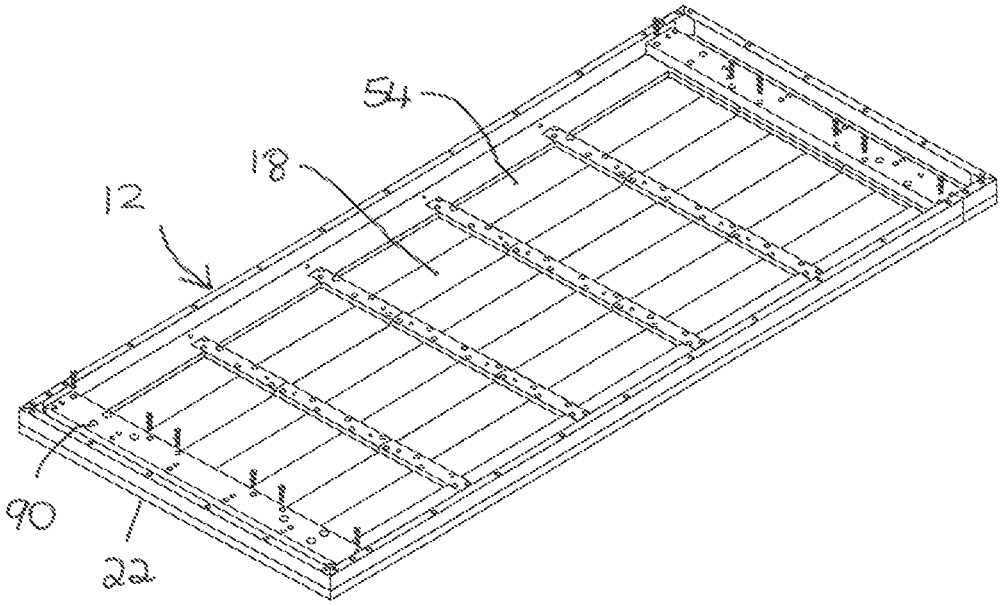
FIG. 5A is a first underside view of the tabletop with the components arranged relative to each other for assembly.
Figure 5B:
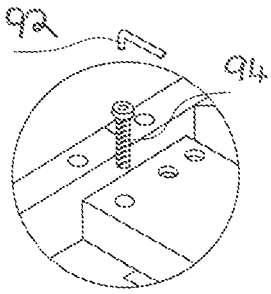
FIG. 5B is a detailed showing assembly of a bolt at one end of the tabletop.

FIG. 4B of the drawings shows a series for collection of the various components which make up the table 10 of the invention, including an assembled table 10 constructed of these components. The table surface 12 is comprised of plank sets or plank units 54, each of the plank units being comprised of three slats 18 bracketed together by a plurality of brackets 80. One slat unit 54 type is for the interior of the table surface 12, as shown in box B, while another slat unit 54 type is for the edge or outer portion of the table surface 12, as shown in box A. The planks set 54 in box B comprise three identical slats 18 fixed together in parallel. The slat cents 54 in box A show two slats 18 positioned together with an end section, the end section having a downwardly depending band or board 62 to provide a quality finish, when observed, to the assembled table 10. Note that the number, dimensions and size of the slats or planks 18 in each slat unit 54 may be varied in accordance with the different embodiments of the invention. Further, each of the slat units 54 may be comprised of a plurality of pieces, rather than a single piece. There may be spaces between slats 18, which may vary in size, or an absence of such spaces to provide a substantially continuous tabletop surface 12.

In FIG. 4B, there is shown an end piece 20 or 22, and there are two of these which fit to the ends of the planks 18, or slat units 54 as appropriate, and provide a finish and cover to any spaces between planks 18 of the slatted portion of the table surface 12. This figure further shows other components of the table 10 in the knockdown format. These include the leg 36, two of which comprise the leg system 14 on each side of the table 10, the transverse or cross bars 38, one for each of the leg systems 14 on either side of the table 10, the connector plate 80 fixed on an upper surface of each of the legs 36 and for positioning between the leg assembly 14 and the end pieces 20 or 22 of the table 10, and a longitudinal bar 40 for stability. The size and shape of all of these components may vary according to the particular characteristics and features of the table 10 of which they form a part.

It will be noted that the end pieces have a dual function of finishing the table surface, and connecting to the remainder of the table surface, but also forming a connection point for the leg assembly. These end pieces are therefore an important structural feature of the table, being adapted as they are to form a *nexus* or connection between the tabletop surface and the supporting legs.

FIGS. 5 to 9 of the drawings illustrate the sequential steps required for assembly of the components into the table 10 of the invention. In FIGS. 5A and 5B of the drawings, the table surface 12 is formed by placing the slatted slat units 54 together, or individual slats 18 as the case may be, as described with reference to previous drawings, with and end piece 20 and 22 at each of the short ends 24 and 26 defined by the assembled slats or planks. Predrilled and accurately located holes 90 are provided at the various points where connection will occur, the holes 90 registering with other such holes 90 on adjacent connection pieces or components. Further, all of the bolts, screws or other types of connectors which are used to connect these parts together are easily located in indicated spaces, which may be explained in an assembly guidance manual or sheet, which may accompany the table 10. As seen in FIG. 5B, a hex key or Allen key 92 is provided as part of the kit, and is appropriately sized so that the user can use the hex key 94 easily fastening and tightening the bolt 94, also seen in FIG. 5B of the drawings.

Figure 6A:
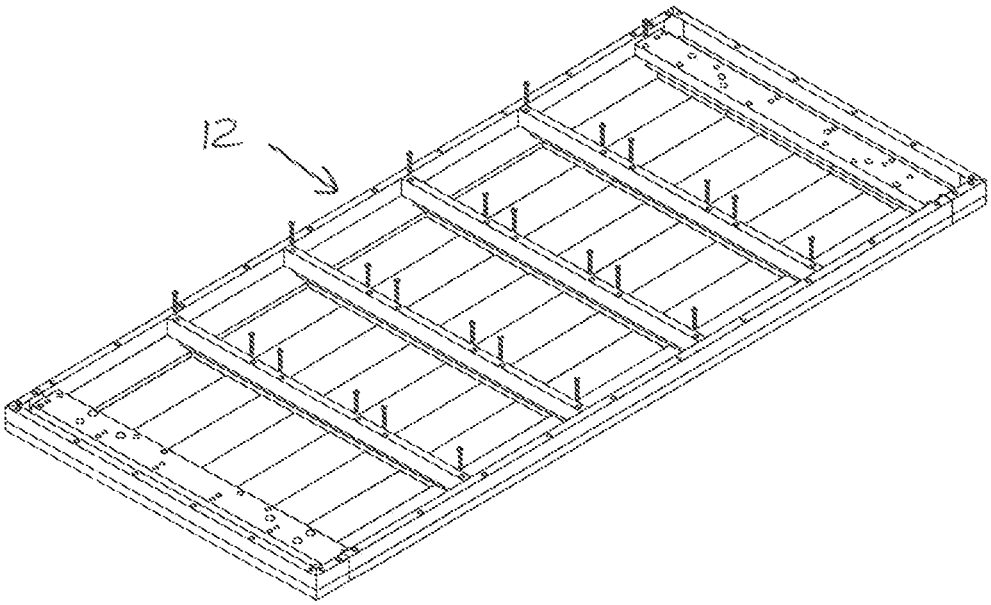
FIG. 6A is a second underside view of the tabletop in the next stage of assembly.
Figure 6B:
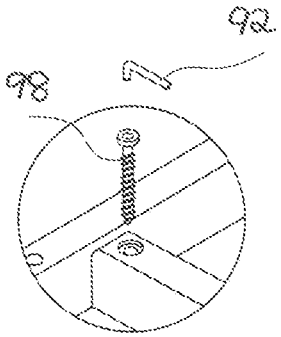
FIG. 6B is a detailed view showing assembly of a connecting screw used to assemble the tabletop.

FIGS. 6A and 6B of the drawings shows the connection of these various components by inserting the screws 98 or bolts, and it is noted that the screw 98 may have an indent in the head thereof which is shaped so as to be able to receive a hex key or Allen key, as described above, for easily connecting and tightening components to each other, using a single standard tool which may be provided with the table 10. In other words, or connecting hardware including bolts and screws will have an appropriately indented head so as to receive a hex key, preferably of one size, so that it is possible in one embodiment for a simple single tool to be used to effect the assembly of the table 10.

Figure 7A:
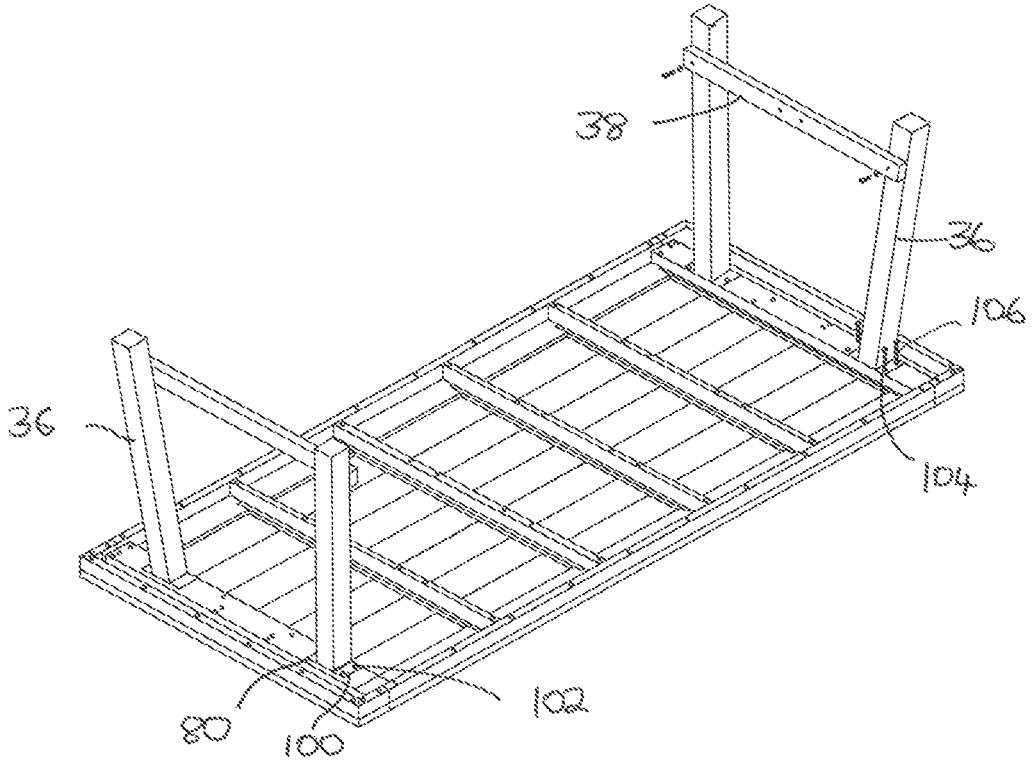
FIG. 7A is a third underside view of the tabletop in the next stage of assembly, showing the fastening of the legs to the tabletop.
Figure 7B:
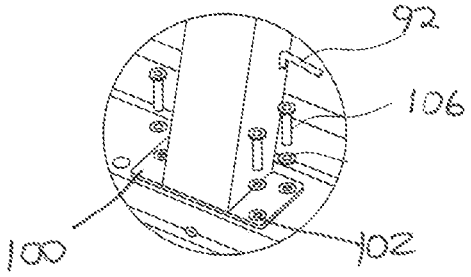
FIG. 7B is a detailed view showing the top of a leg and its mechanism for fastening to the tabletop.

In FIGS. 7A and 7B of the drawings show the next step in the assembly process. In this step, each of the four legs 36 is installed. Each leg 36 has at its top portion a connector plate 80, with extending side flanges 100, and the side flanges 100 include holes 102 which correspond to holes 104 on end pieces 20 and 22, so that bolts 106 or screws can be utilized to firmly secure these components together. The detail in FIG. 7B of the drawings shows one embodiment illustrating how this may be accomplished.

Figure 8A:
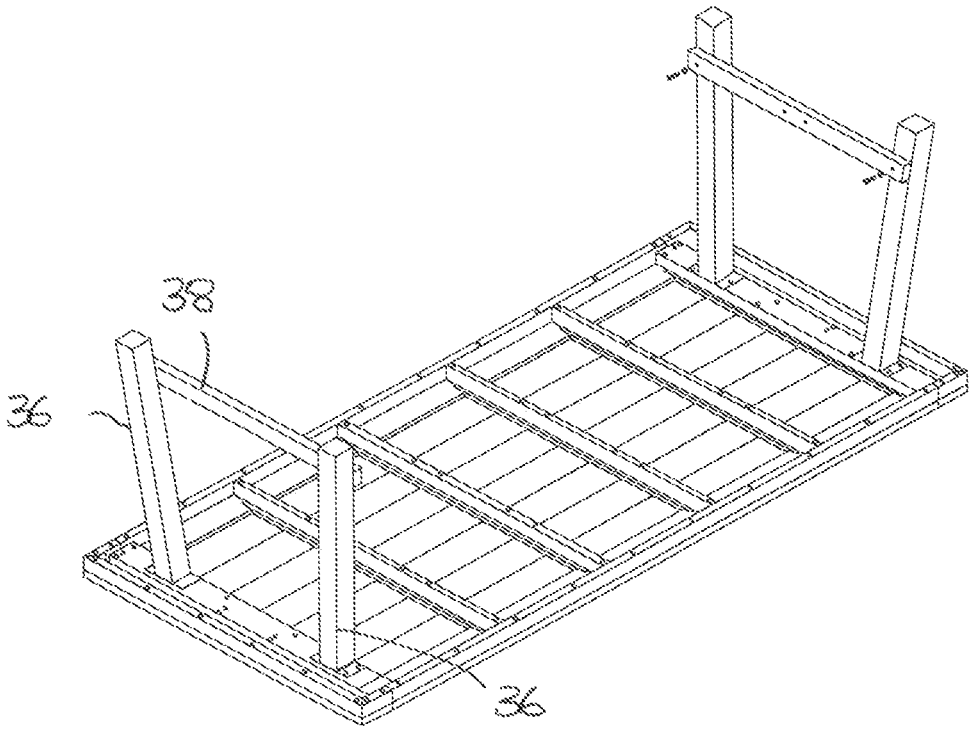
FIG. 8A is a fourth underside view of the tabletop in the next stage of assembly, showing the fastening of a connecting bar between a pair of legs on each side of the tabletop.
Figure 8B:
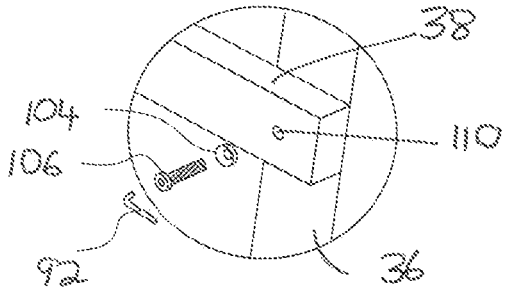
FIG. 8B is a detail showing the mechanism for connecting the connecting bar illustrated in FIG. 8A of the drawings.

FIGS. 8A and 8B of the drawings show the next step in the assembly process. In this step, there is shown the connection of the crossbar 38 between a pair of legs 36 on each side of the table 10, providing additional stability. Once more, predrilled holes 110 in the crossbar 38 are utilized to engage with corresponding holes in the leg 36 so that these components can be mated and registered with each other, and then bolted or screwed together. FIG. 8B shows a detail of one form of connection between the crossbar 38 and a leg 36.

Figure 9A:
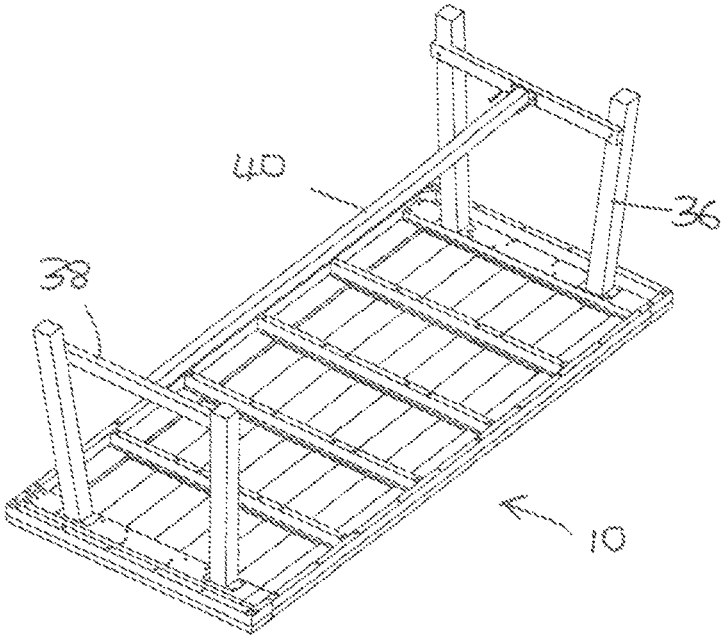
FIG. 9A is a fifth underside view of the tabletop illustrating the next stage of assembly, showing the insertion of a crossbeam or bar between the legs of the table.
Figure 9B:
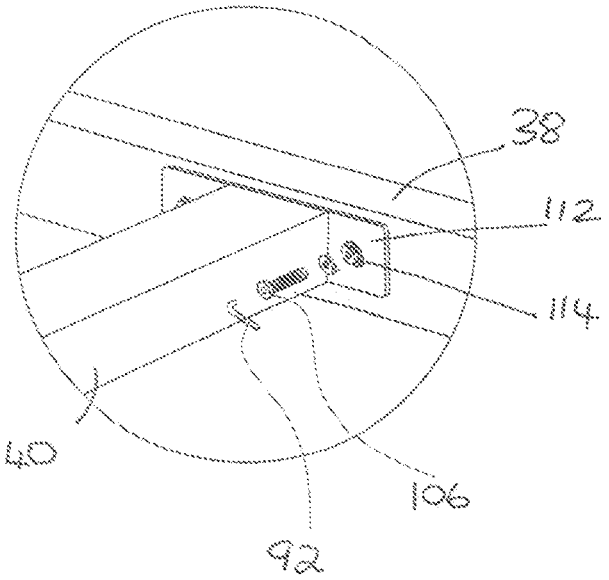
FIG. 9B is a detail showing the mechanism for connecting the crossbeam illustrated in FIG. 9A of the drawings.

Finally, in FIGS. 9A and 9B of the drawings, there is shown the final assembly steps. In this step, the longitudinal bar 40, having an extended flange or plate 112 at each of its ends with predrilled holes 114, is installed between the pairs of legs 36 on each side of the table 10, to provide further form and structure, and enhancing the stability of the table 10. In smaller tables 10, it may be possible to eliminate the need for this longitudinal bar 40, but it is available for use if circumstances require it. In most cases, it will be beneficial in providing an additional level of stability to the table 10 when in the assembled form.

FIG. 10 comprises a list of the various components which may be utilized in constructing a table of the present invention, including dimensions and measurements of the various parts in a preferred embodiment of the invention. It will be appreciated that the table of the invention is not limited to one having the specific sizes and dimensions mentioned in these figures, and that any desired shape or size table would fall within the scope of the invention. These measurements and dimensions therefore reflect only one embodiment of a table which may be constructed in accordance with the invention.

Figure 11A:
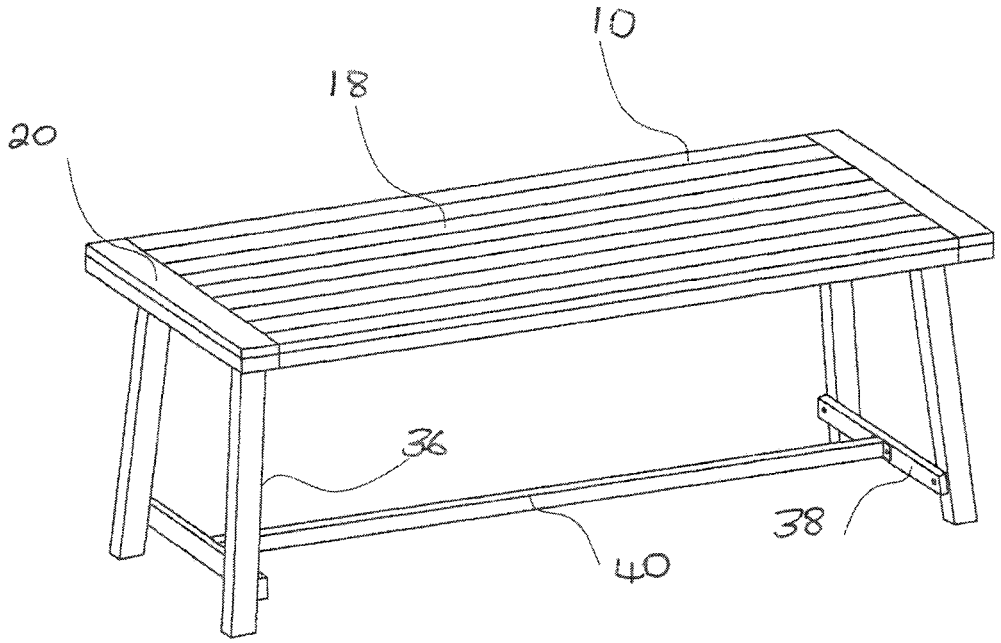
FIG. 11A illustrates a top perspective view of the assembled table following the steps as indicated in the preceding drawings.
Figure 11B:
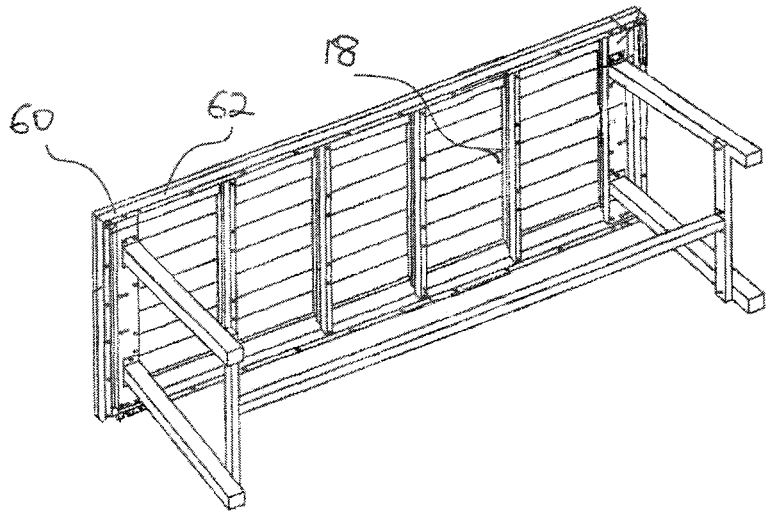
FIG. 11B illustrates a bottom perspective view of an assembled table utilizing the components and following the steps as set out in the preceding figures and description.

FIGS. 11A and 11B show, respectively, a top perspective view and a bottom perspective view of the fully constructed table assembly in accordance with the specified components and assembly steps described above. It is to be noted that each and all of the parts can be disassembled from each other, so that the table can be packed for transportation or storage purposes in a compact condition, in order to save space and to enhance its flexibility in terms of ability to move. Thus, a strong, attractive and stable table is provided, but also one which can be readily and easily assembled and disassembled according to needs and circumstances. Moreover, the table may be used on a temporary basis when needed. Thus, a business or home may have the components of the table stored in an appropriately sized box or container, and may only be needed periodically on specific occasions. On these occasions, the components of the table can be unpacked and relatively easily assembled for use when larger functions or meetings are taking place, an additional surface space may be required for one or more reasons.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A table assembly comprising:

a table surface having a first end and a second end;

a first end piece connectable to the first end of the table surface and a second end piece connectable to the second end of the table surface;

a first leg assembly connectable to the first end piece and a second leg assembly connectable to the second end piece, each of the first and second leg assemblies comprising a pair of lateral legs having an upper surface connectable to its respective end piece, and a crossbar connectable to an extending between each of the pair of lateral legs;

a support bar extending between the crossbar of the first leg assembly and the crossbar of the second leg assembly, the support bar having opposing ends connectable to the first leg assembly and second leg assembly respectively; and a connector plate on the upper surface of each of the lateral legs, wherein each connector plate comprises a central portion connected to the upper surface of the leg, a pair of lateral connector portions on each side of the central portion, and fastening means for securing the legs to the first end piece or the second end piece.

2. A table assembly as claimed in claim 1 wherein the table surface comprises a plurality of parallel slats.

3. A table assembly as claimed in claim 2 wherein at least some of the plurality of parallel slats are fixed to each other to form a slat unit.

4. A table assembly as claimed in claim 3 wherein the table surface comprises two slat units, each slat unit having an upper surface and a lower surface, the slat units being releasably connected to each other so that the upper surface of one slats unit is coplanar with the upper surface of the other slat unit, the upper surfaces of the two slat units providing the table surface which is substantially flat.

5. A table assembly as claimed in claim 2 further comprising brackets for connecting together a plurality of slats.

6. A table assembly as claimed in claim 1 wherein the table surface, first end piece, second end piece, first leg assembly and second leg assembly are releasably connectable to each other so that the table assembly can be selectively constructed and deconstructed.

7. A table assembly as claimed in claim 1 wherein the first end piece and the second end piece each have an upper surface and a lower surface, the upper surface being continuous with the table surface when the table assembly is assembled.

8. A table assembly as claimed in claim 7 further comprising a connector plate receiving area on the lower surface of the first end piece and the second end piece to which the connector plate is releasably attached.

9. A table assembly as claimed in claim 1 wherein the pair of lateral connector portions include predrilled holes on each side of the central portion, and the fastening means secure the legs to the first end piece or the second end piece utilizing the predrilled holes in the lateral connector portions.

10. A table assembly as claimed in claim 1 wherein the table surface, the first end piece, the second end piece, the first leg assembly, the second leg assembly, connecting bolts and screws are individual unattached components in a deconstructed form, and further comprising a tool for tightening or loosening the bolts or screws for constructing or deconstructing the table assembly.

* * * * *